United States Patent [19]

Ho

[11] Patent Number: 4,776,591

[45] Date of Patent: Oct. 11, 1988

[54] RACKET STRING STRAIGHTENER

[76] Inventor: Sai K. Ho, 53 Blue Pool Road, 2nd Floor, Happy Valley, Hong Kong

[21] Appl. No.: 511

[22] Filed: Jan. 5, 1987

[30] Foreign Application Priority Data

Jan. 8, 1986 [GB] United Kingdom ..... 8600316

[51] Int. Cl.[4] ..... A63B 51/00

[52] U.S. Cl. ..... 273/73 R; 273/73 A

[58] Field of Search ..... 273/73 D, 73 A, 73 B, 273/281, 282 R, 282 C; 28/212, 213, 152, 115; 38/102.91; 264/174, 291; 29/241; 242/157 R; 269/900, 903, 41; 226/196

[56] References Cited

U.S. PATENT DOCUMENTS

| | | | |
|---|---|---|---|
| 2,268,276 | 12/1941 | Caro et al. | 273/73 A |
| 2,890,516 | 6/1959 | Kasper | 28/213 |
| 3,734,374 | 5/1973 | Perry | 242/157 R X |
| 4,082,272 | 4/1978 | Garver | 273/73 A |
| 4,089,523 | 5/1978 | Newburger et al. | 273/73 R |
| 4,489,942 | 12/1984 | Kent | 273/73 R |

FOREIGN PATENT DOCUMENTS

| | | | |
|---|---|---|---|
| 429526 | 5/1935 | United Kingdom | 273/73 A |

*Primary Examiner*—Richard C. Pinkham
*Assistant Examiner*—William E. Stoll
*Attorney, Agent, or Firm*—Irving M. Weiner; Pamela S. Burt; Joseph P. Carrier

[57] ABSTRACT

A racket string straightner including an elongate holder having a straight row of individually slidable teeth mounted therein. Each tooth has a string-receiving notch, and the notches are aligned along the row so as to straighten a string received therein. An aperture is provided in each tooth so as to extend transversely to the longitudinal axis of the holder, for receiving a string transverse to the string to be straightened.

11 Claims, 2 Drawing Sheets

RACKET STRING STRAIGHTENER

BACKGROUND TO THE INVENTION

1. Field of Invention

This invention relates to a device for straightening the strings of rackets, e.g., tennis, squash, or badminton rackets.

2. Description of Prior Art

When viewed face-on, the strings of a racket should be straight. During play the strings may become displaced so that they are no longer straight. It is usual for players to straighten displaced strings with their fingers, but it will be appreciated that this is not an accurate method, and any inaccuracy will result in a deterioration in the performance of the racket.

SUMMARY OF THE INVENTION

The present invention provides a racket string straightener comprising a straight row of teeth mounted in and slidable along an elongate holder, each tooth having a string-receiving notch at its free end, the notches being aligned along the row.

Thus, by applying the straightener to a string in such a manner that the string is forced into the notches, the string is automatically straightened.

The invention will be described further, by way of example, with reference to the accompanying drawings.

DETAILED DESCRIPTION OF PREFERRED EMBODIMENT

Figure 1:
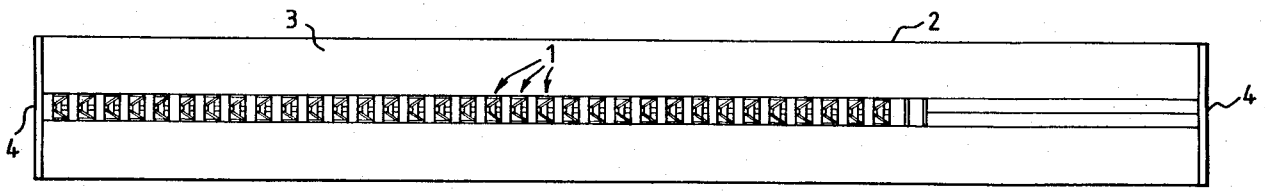
FIG. 1 is a plan view of a device for straightening the strings of a tennis racket individually.

The tennis racket string straightener illustrated comprises a straight row of 33 plastics teeth 1 mounted in a holder 2 which is 450 mm long. The holder 2 consists of an extruded aluminium body 3 of generally triangular profile, 57 mm wide and 27 mm deep, whose ends are closed by 3 mm thick plastics plates 4.

Each tooth 1 has an enlarged inner end 6 (maximum width 30 mm) which is slidably accommodated in an undercut longitudinal slot in the holder 2. The enlarged end 6 projects both forwardly and rearwardly of the tooth and has a length of 25 mm. The forward projection has a stepped external surface 5 of arcuate profile matching the internal surface 5' of a recess in the rearward part of the enlarged end 6. The surfaces 5 and 5' of adjacent teeth thus cooperate when the teeth are pushed towards each other, defining a given minimum spacing of the upwardly projecting parts of the teeth and assisting in securing the teeth against rocking in the longitudinal direction of the holder.

Figure 2:
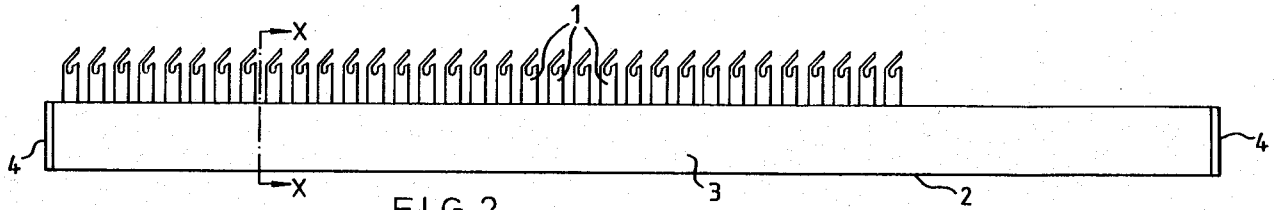
FIG. 2 is a side elevation of the device.
Figure 8:
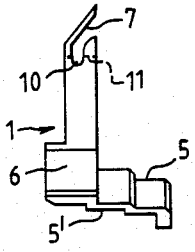
Figure 9:
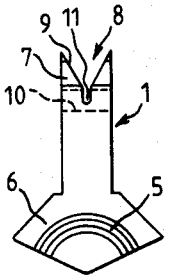
Figure 10:
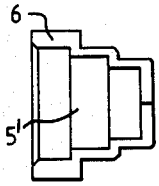

The teeth 1 have a thickness of 6 mm, but over the last 7.5 mm of their length they decrease gradually in thickness to a tip (FIGS. 2 and 8). They project up from the holder 2 by 26 mm, the width of the upwardly projecting part being 10 mm.

At its free end each tooth 1 has a string-receiving notch 8 comprising a V-shaped entry section 9 (7.5 mm deep) tapering to a U-shaped recess 11 (2.5 mm deep, 1.5 mm wide) having substantially parallel sidewalls and a rounded base. The free end also has a transverse string-receiving aperture having an oblique lateral entry section 7 leading to a groove 10 whose base is below that of the recess 11.

Figure 3:
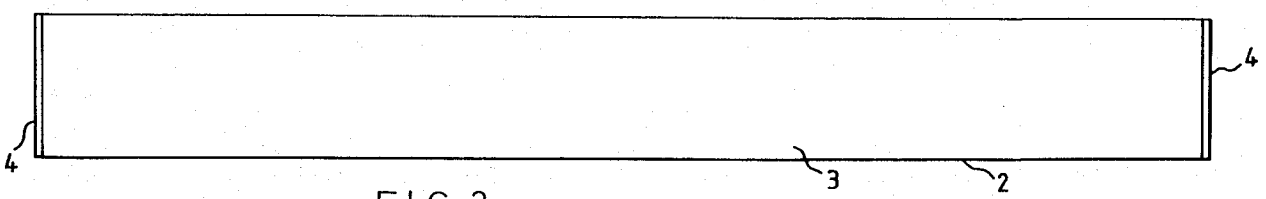
FIG. 3 is a bottom view of the device.
Figure 4:
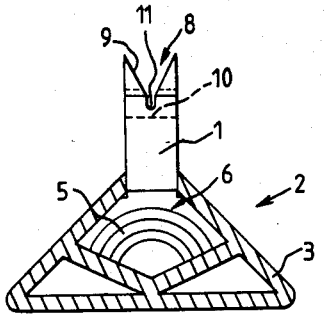
FIG. 4 is an enlarged section on line X—X in FIG. 2.
Figure 5:
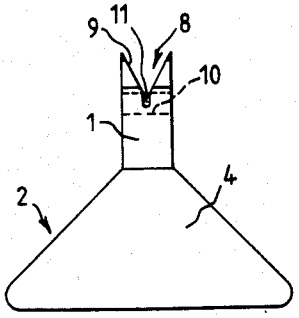
FIG. 5 is an enlarged end view of the device.
Figure 6:
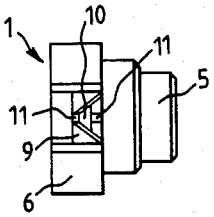
FIG. 6 is an enlarged plan view of one tooth of the device.
Figure 7:
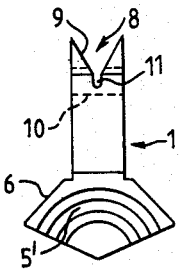
FIGS. 7 to 10 are enlarged views of the tooth from one end, one side, the other end, and the bottom, respectively.

To straighten a string, the straightener is located so that the notches 8 face the string. The string is then pushed towards the straightener so that it enters the recesses 11, being guided into them by the tapering sections 9; at the same time the teeth 1 slide along the holder 2 insofar as is necessary to accommodate the strings which are transverse to the string being straightened. The transverse strings enter the grooves 10 in a proportion of the teeth. Since the notches 8 are aligned along the straight row of teeth 1 (see FIGS. 3 and 5), the string is straight when it is received by the recess 11.

By use of the above-described device, which can fit all regular, mid-size, and large-head rackets, the strings can be maintained in their best and straight positions before and after a game. This will prolong the life of the strings and enhance the performance of the racket.

I claim:

1. A portable racket string straightener comprising an elongate holder having a forward end, a rearward end, a bottom, a top and two sides, and a straight row of unconnected teeth mounted in and individually freely slidable along said holder, each tooth having a free end projecting above the top of said holder, and a string-receiving notch at said free end thereof, said notch having an opening directed upwardly and towards said forward and rearward ends of said holder, said forwardly and rearwardly directed openings of all said notches being aligned along said row.

2. The racket string straightener of claim 1, wherein each said notch has a tapering entry section leading from said upwardly directed opening to a recess having substantially parallel sidewalls.

3. The racket string straightener as claimed in claim 2, wherein said recess has a rounded base.

4. The racket string straightener of claim 2, wherein said free end of each said tooth has an aperture extending transversely to the longitudinal axis of said elongate holder, for receiving a string transverse to the string to be straightened.

5. The racket string straightener of claim 4, wherein said aperture has an oblique lateral entry section leading to a groove having a base which is below the bottom of said notch.

6. The racket string straightener of claim 1, wherein the thickness of each tooth decreases toward said free end thereof.

7. The racket string straightener of claim 1, wherein the inner end of each said tooth is of enlarged width and is accommodated in an undercut longitudinal slot in said holder.

8. The racket string straightener of claim 7, wherein said inner end has a forwrd projection and a matching rearward recess for receiving the corresponding forward projection of said inner end of the rearwardly adjacent tooth.

9. A racket string straightener comprising:

an elongate holder having a forward end, a rearward end, a bottom , a top and two sides, and a straight row of teeth mounted in and slidable along said holder;

each said tooth having a free end projecting above said top of said holder, an inner end mounted in said holder, and a string-receiving notch at said free end thereof, the notches being aligned along said row;

said inner end of each tooth being of enlarged width and accommodated in an undercut longitudinal slot in said holder; and said inner end of each tooth having a forward projection and a matching rearward recess for receiving the corresponding forward projection of said inner end of a rearwardly adjacent tooth.

10. A racket string straightener comprising:

an elongate holder having a forward end, a rearward end, a bottom, a top and two sides, and a straight row of teeth mounted in and slidable along said holder;

each said tooth having a free end projecting above said top of said holder, an inner end mounted in said holder, and a string-receiving notch at said free end thereof, the notches being aligned along said row;

said free end of each tooth having an aperture extending transversely to the longitudinal axis of said elongate holder, for receiving a string transverse to the string to be straigtened.

11. The racket string straightener of claim 10, wherein said aperture has an oblique lateral entry section leading to a groove having a base which is below the bottom of said notch.

* * * * *

UNITED STATES PATENT AND TRADEMARK OFFICE

CERTIFICATE OF CORRECTION

PATENT NO. : 4,776,591

DATED : October 11, 1988

INVENTOR(S) : Sai K. HO

It is certified that error appears in the above-identified patent and that said Letters Patent is hereby corrected as shown below:

Column 2, line 62 (claim 8, line 2), change "forwrd" to --forward--.
Column 4, line 11 (claim 10, line 14), correct the spelling of --straightened--.
In the Abstract, line 1, correct the spelling of --straightener--.

Signed and Sealed this

Eighteenth Day of April, 1989

*Attest:*

DONALD J. QUIGG

*Attesting Officer*

*Commissioner of Patents and Trademarks*